US007407622B2

(12) United States Patent
Voice et al.

(10) Patent No.: US 7,407,622 B2
(45) Date of Patent: Aug. 5, 2008

(54) METHOD OF MANUFACTURING A METAL ARTICLE BY POWDER METALLURGY

(75) Inventors: Wayne E Voice, Nottingham (GB); Junfa Mei, Birmingham (GB)

(73) Assignee: Rolls-Royce plc, London (GB)

( * ) Notice: Subject to any disclaimer, the term of this patent is extended or adjusted under 35 U.S.C. 154(b) by 444 days.

(21) Appl. No.: 11/273,027

(22) Filed: Nov. 15, 2005

(65) Prior Publication Data

US 2006/0127265 A1 Jun. 15, 2006

(30) Foreign Application Priority Data

Dec. 10, 2004 (GB) ..... 0427075.7

(51) Int. Cl.
*B22F 3/14* (2006.01)
*B22F 5/10* (2006.01)

(52) U.S. Cl. ..... 419/5; 419/48; 419/49

(58) Field of Classification Search ..... 419/5, 419/8, 48, 49
See application file for complete search history.

(56) References Cited

U.S. PATENT DOCUMENTS 4,142,888 A * 3/1979 Rozmus ..... 419/49
4,927,600 A 5/1990 Miyashita
5,130,084 A * 7/1992 Matheny et al. ..... 419/8
6,168,871 B1 * 1/2001 Ritter et al. ..... 428/548
2004/0191069 A1 * 9/2004 Motherwell ..... 416/233
2005/0214156 A1 * 9/2005 Troitski et al. ..... 419/49

FOREIGN PATENT DOCUMENTS

EP 1 075 885 A 12/2001
EP 1 260 300 A 11/2002
GB 1 399 669 SP 7/1975
GB 1 400 118 SP 7/1975
GB 2 306 353 A 5/1997
JP 58141896 AB 8/1983

* cited by examiner

*Primary Examiner*—Roy King
*Assistant Examiner*—Ngoclan T Mai
(74) *Attorney, Agent, or Firm*—W. Warren Taltavull; Manelli Denison & Selter PLLC

(57) ABSTRACT

A method of manufacturing a fan blade (26) for a gas turbine engine by powder metallurgy comprises the steps of forming a container (52) and placing at least one metal insert (52) at a predetermined position within the container (52) and filling the container (52) with metal powder (60). The at least one metal insert (62) has a predetermined pattern of stop off material (68,70) on at least one surface of the metal insert (64,66). The container (52) is evacuated and then sealed. The container (52) is hot pressed to consolidate the metal powder (60) into a consolidated metal powder preform (72). The container (52) is removed from the consolidated metal powder preform (72). The consolidated metal powder preform (72) is heated and a fluid is supplied to the predetermined pattern of stop off material (68,70) to hot form at least a portion of the consolidated metal powder preform (72) to form the hollow metal fan blade (26).

13 Claims, 3 Drawing Sheets

METHOD OF MANUFACTURING A METAL ARTICLE BY POWDER METALLURGY

The present invention relates to a method of manufacturing a metal article by powder metallurgy.

In powder metallurgy, metal powder is consolidated by sintering, by hot pressing or by hot isostatically pressing (HIPing). Sintering and hot isostatic pressing are relatively expensive processes.

Conventionally metal powder is produced by atomising a molten metal.

New methods of producing metal powder are described in WO01/62994A, published 30 Aug. 2001 and WO2004/024963A, published 25 Mar. 2004. However, the metal powders produced by these new methods have low packing densities that are not amenable to sintering and consolidation by hot isostatic pressing (HIPing). In hot isostatic pressing the metal powder is placed in a container, which is evacuated and sealed, and then pressed at high temperature, but these new metal powders suffer from large changes in shape of the container in which the metal powder is placed and this makes it difficult to predict the final shape of the consolidated metal powder.

It is known from UK patent No. GB2306353 to produce fan blades, and/or fan outlet guide vanes, of gas turbine engines by machining two metal workpieces, and possibly a third metal workpiece, to predetermined shapes, then diffusion bonding the workpieces together and then hot forming, or superplastically forming, at least one of the metal workpieces to form a hollow article.

This method of producing fan blades and/or fan outlet guide vanes is complex with many machining and forming operations.

Accordingly the present invention seeks to provide a novel method of manufacturing a metal article by powder metallurgy, which overcomes the above-mentioned problems.

Accordingly the present invention provides a method of manufacturing an article by powder metallurgy comprising the steps of (a) forming a container, (b) filling the container with metal powder, (c) evacuating the container, (d) sealing the container, (e) hot pressing the container to consolidate the metal powder into a consolidated metal powder preform, (f) removing the container from the consolidated metal powder preform, (g) thermo-mechanically working or machining at least a portion of the consolidated metal powder preform to form a hollow metal article.

The thermo-mechanical working comprises forging.

Preferably the method comprises the steps of (a) forming a container, (b) placing at least one metal insert at a predetermined position within the container and filling the container with metal powder, the at least one metal insert having a predetermined pattern of stop off material on at least one surface of the metal insert, (c) evacuating the container, (d) sealing the container, (e) hot pressing the container to consolidate the metal powder into a consolidated metal powder preform, (f) removing the container from the consolidated metal powder preform, (g) heating the metal powder preform and supplying a fluid to the predetermined pattern of stop off material to hot form at least a portion of the consolidated metal powder preform to form a hollow metal article.

Preferably step (a) comprises forming two workpieces and welding the workpieces together to form the container.

Preferably step (a) comprises cold pressing the workpieces to a predetermined shape to form the container.

Preferably step (a) comprises forming the container from metal, preferably steel, more preferably mild steel.

Preferably step (e) comprises hot pressing the container in shaped dies. Step (e) may comprise hot isostatic pressing.

Preferably step (f) comprises peeling off the container or dissolving the container in an acid.

Preferably the metal powder comprises a titanium alloy. However, the metal powder may comprise other suitable metals or alloys.

Preferably the metal insert comprises a titanium alloy.

Preferably the stop off material comprises yttria.

Preferably step (g) comprises supplying a gas to the predetermined pattern of stop off material.

Preferably the article is a component of a gas turbine engine.

Preferably the article is a compressor blade, a compressor vane, a fan blade or a fan outlet guide vane.

The present invention will be more fully described by way of example with reference to the accompanying drawings in which.

Figure 1:
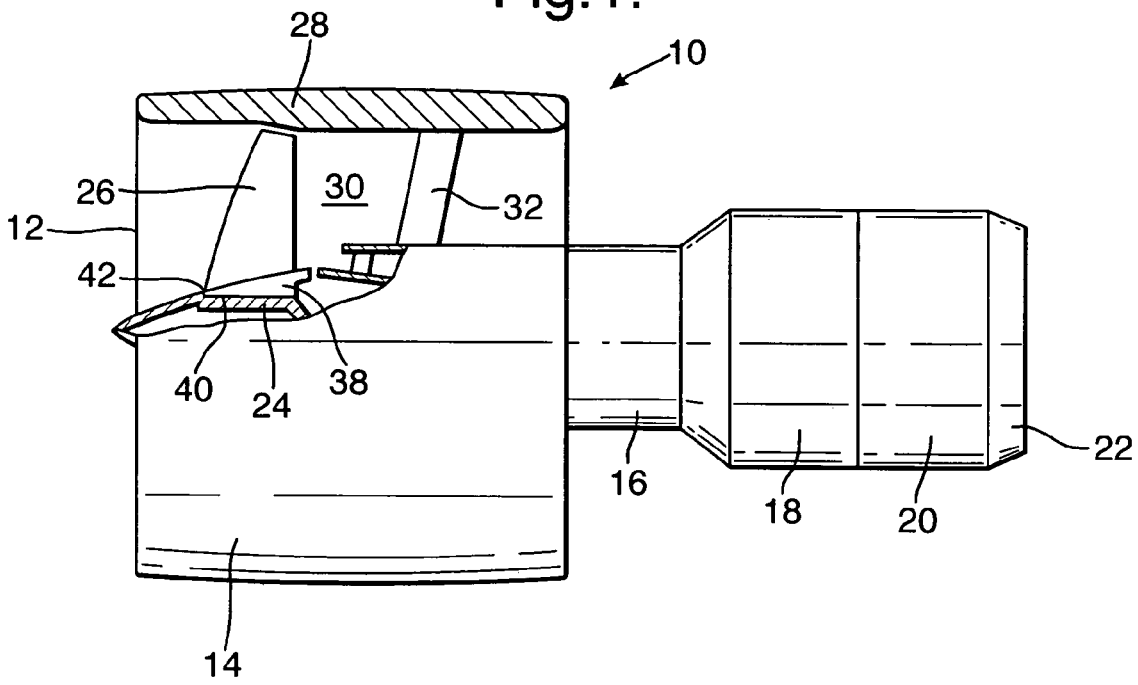
FIG. 1 is a partially cut away view of a gas turbine engine having a fan blade manufactured according to the present invention.

A turbofan gas turbine engine 10, as shown in FIG. 1, comprises in flow series an intake 12, a fan section 14, a compressor section 16, a combustion section 18, a turbine section 20 and an exhaust 22. The fan section 14 comprises a fan rotor 24 carrying a plurality of circumferentially spaced radially outwardly extending fan blades 26. The fan blades 26 are arranged in a bypass duct 28 defined by a fan casing 30, which surrounds the fan rotor 24 and fan blades 26. The fan casing 30 is secured to a core engine casing 34 by a plurality of circumferentially spaced radially extending fan outlet guide vanes 32. The fan rotor 24 and fan blades 26 are arranged to be driven by a turbine (not shown) in the turbine section 20 via a shaft (not shown). The compressor section 16 comprises one or more compressors (not shown) arranged to be driven by one or more turbines (not shown) in the turbine section 20 via respective shafts (not shown).

Figure 2:
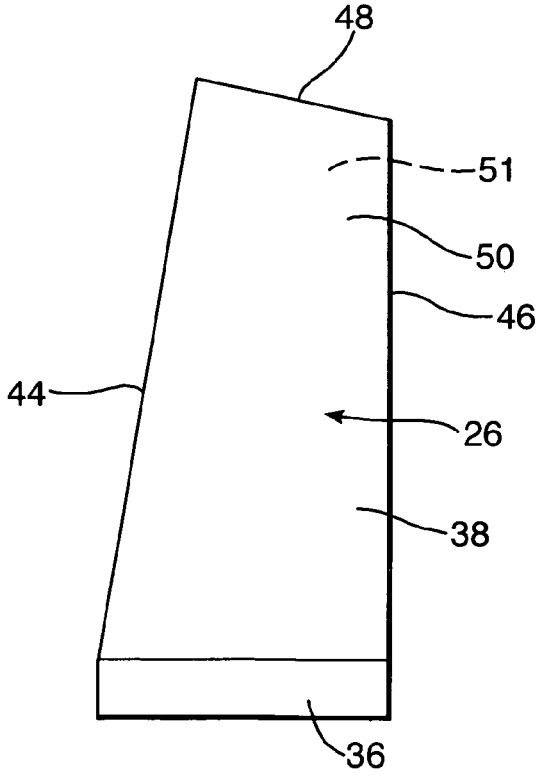
FIG. 2 is an enlarged view of the fan blade shown in FIG. 1.

The fan blade 26 is shown more clearly in FIG. 2. The fan blade 26 comprises a root portion 36 and an aerofoil portion 38. The root portion 36 is arranged to locate in a slot 40 in the rim 42 of the fan rotor 24, and for example the root portion 36 may be dovetail shape, or firtree shape, in cross-section and hence the corresponding slot 40 in the rim 42 of the fan rotor 24 is the same shape. The aerofoil portion 38 has a leading edge 44, a trailing edge 46 and a tip 48 remote from the root portion 36 and the fan rotor 24. A concave pressure surface 50 extends from the leading edge 44 to the trailing edge 46 and a convex suction surface 51 extends from the leading edge 44 to the trailing edge 46.

Figure 3:
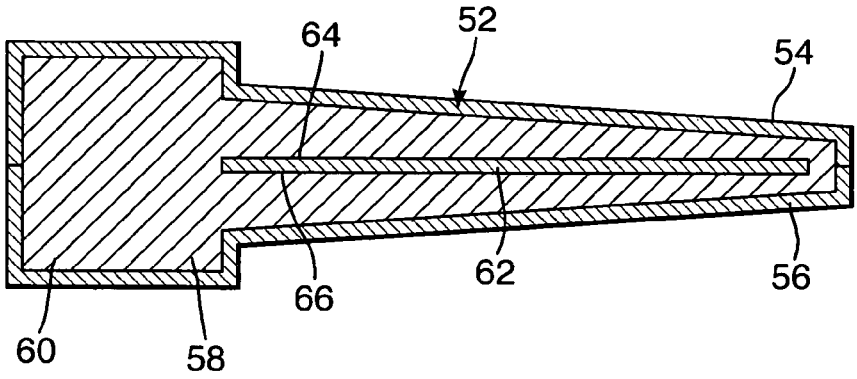
FIG. 3 is a cross-sectional view through a sealed container containing metal powder and a metal insert.
Figure 4:
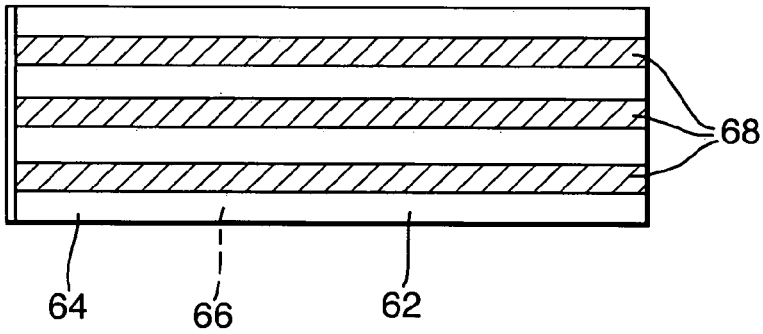
FIG. 4 is a view of metal insert and a predetermined pattern of stop off material on one surface of the metal insert.

A method of manufacturing a fan blade 26 by powder metallurgy according to the present invention is shown with reference to FIGS. 3 to 8. The method of manufacturing the fan blade 26 comprises forming a container 52. The container 52 comprises two steel workpieces, steel sheets, 54 and 56. The steel sheets, preferably mild steel sheets, 54 and 56 are cold pressed to a predetermined shape, which is modelled such that a subsequent hot pressing process does not compress, or consolidate, significant amounts of metal powder perpendicular to the loading direction. The peripheries of the steel sheets 54 and 56 are welded together to form the container 52 and to define a cavity 58 within the container 52. It is preferred that the container 52 is a simple shape. Metal powder, titanium alloy e.g. Ti 6 wt % Al, 4 wt % V, 60 is supplied into the cavity 58 within the container 52 together with a metal insert, titanium alloy e.g. Ti 6 wt % Al, 4 wt % V, 62, as shown in FIG. 3. The metal insert 62 is provided with a predetermined pattern of stop off material, e.g. yttria, 68, 70 on the surfaces 64 and 66 of the metal insert 62, as shown in FIG. 4. The container 52 is then evacuated and sealed.

Figure 5:
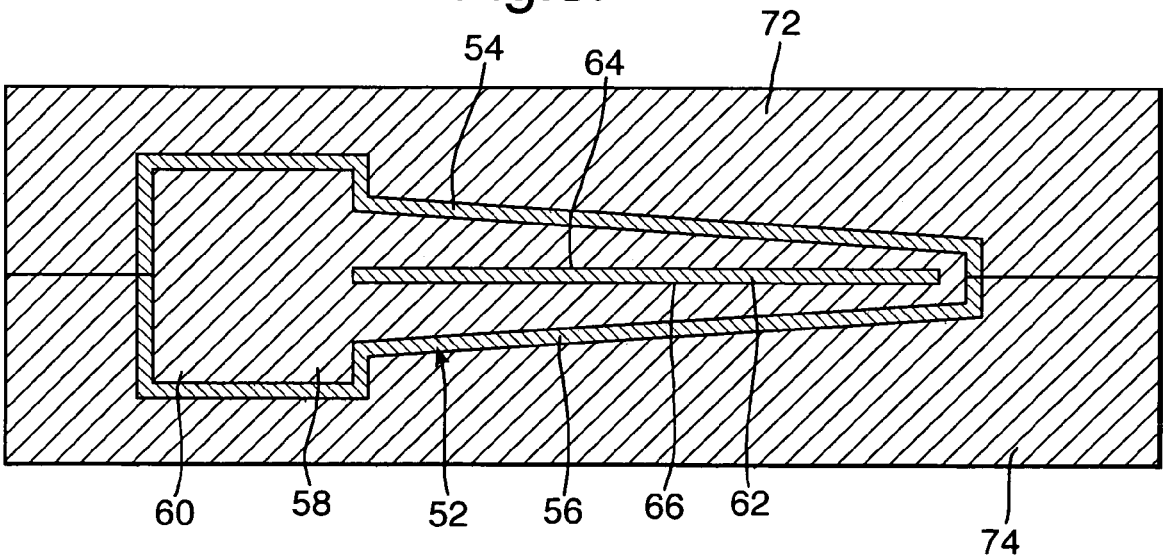
FIG. 5 is a cross-sectional view through the sealed container containing metal powder and metal insert as placed in shaped dies prior to consolidation.

The container 52 is then placed between shaped dies 72, 74, as shown in FIG. 5, in a hydraulic press and hot pressed at a suitable temperature and at a relatively low strain rate to consolidate the metal powder 60 and to diffusion bond the metal powder 60 to the metal insert 62, except at those positions on the faces 64 and 66 where the predetermined pattern of stop off material 68 and 70 has been applied, to form a consolidated metal powder preform 72. The container is heated to a temperature of 930° C. for a titanium alloy e.g. Ti 6 wt % Al, 4 wt % V.

The consolidated metal powder preform 72 is then removed from the container 52 by cutting an edge of the container 52 for example by abrasive water jet cutting, laser cutting etc., and then peeling off the remainder of the container 52. Alternatively the container 52 may be removed by dissolving in a suitable acid.

Figure 6:
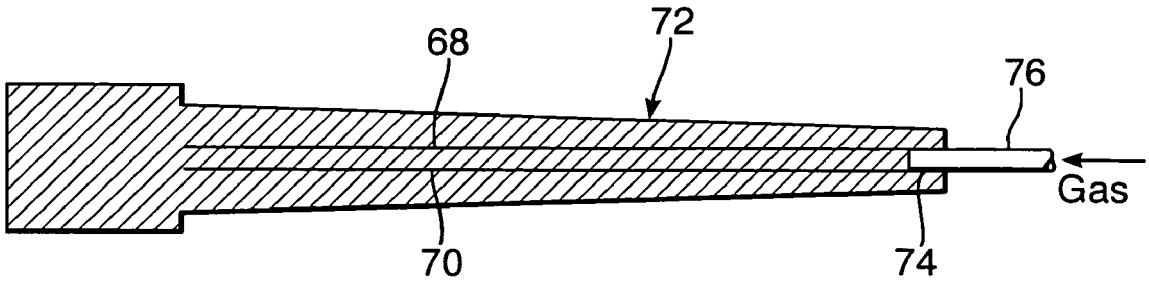
FIG. 6 is a view of a consolidated metal powder preform prior to superplastic forming.
Figure 7:
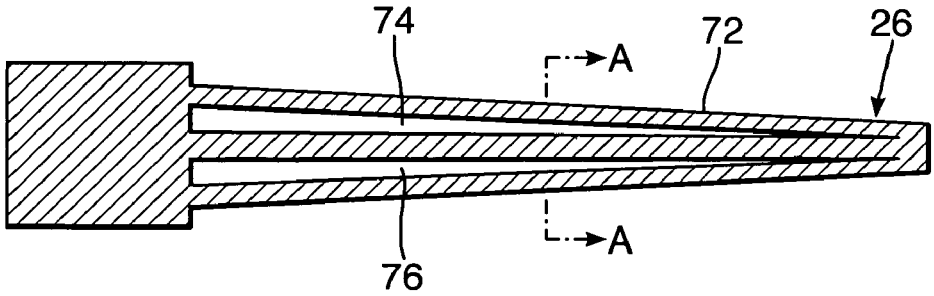
FIG. 7 is a view of the consolidated metal powder preform after superplastic forming.
Figure 8:
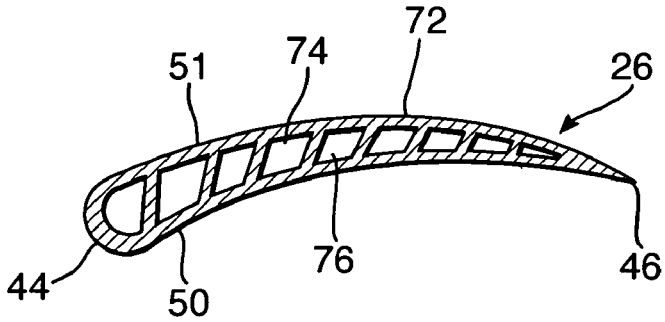
FIG. 8 is a sectional view along line A-A in FIG. 7.

An aperture 74 is drilled into the consolidated metal powder preform 72 and a pipe 76 is inserted into the aperture 74 and sealed to the consolidated metal powder preform 72 connected to the predetermined pattern of stop off material 68 and 70 in the consolidated metal powder preform 72, as shown in FIG. 6. The consolidated metal powder preform 72 is then placed in a hot forming die, e.g. a superplastic-forming die, and is heated to a temperature suitable for hot forming or superplastic forming. The hot forming die, or superplastic-forming die, defines the finished shape of the fan blade 26. A pressurised inert gas is supplied through the pipe 76 to inflate the consolidated metal powder preform 72 in the regions where the predetermined pattern of stop off material 68 and 70 was applied to form the hollow fan blade 26 with one or more internal cavities 74, 76 as shown in FIGS. 7 and 8. The consolidated metal powder preform 72 is heated to a temperature of about 930° C. to superplastically form, or hot form, a titanium alloy e.g. Ti 6 wt % Al, 4 wt % V.

Some final machining of the hollow fan blade 26 may be required to produce the root section 36, e.g. to produce a dovetail root or a firtree root, or to accurately produce the leading edge 44 and trailing edge 46.

Although the present invention has been described with reference to manufacturing a fan blade, the present invention may be used to manufacture other components of a gas turbine engine or other articles. For example the present invention may be used to manufacture a compressor blade, a compressor vane or a fan outlet guide vane. The stop off material may be applied to only one surface of the metal insert and the stop off material may be applied to produce any suitable arrangement of cavities, and may if required produce only a single cavity, for example for a fan outlet guide vane.

In a second example of the present invention it is possible to provide a metal, or alloy, insert or other material insert at a predetermined position within the container and to fill the container with metal powder. The insert does not have a stop off material. The container is then evacuated, sealed and hot pressed to consolidate the metal powder into a consolidated metal powder preform. The container is placed between shaped dies in a hydraulic press and hot pressed at a suitable temperature and at a relatively low strain rate to consolidate the metal powder. Then the consolidated metal powder preform is forged and/or machined to form the final shape of a metal article. The insert may have high strength and the metal powder may be malleable to produce a metal article with a high strength inner core and a malleable outer shell, which may be shaped to the shape of the metal article. The insert may have high strength and the metal powder may be environmentally resistant, e.g. corrosion, oxidation, high temperature resistance to produce a metal article with a high strength inner core and an environmentally resistant outer shell.

In another example of the present invention it is possible to dispense with the insert. The container is filled with metal powder, the container is then evacuated, sealed and hot pressed to consolidate the metal powder into a consolidated metal powder preform. The container is placed between shaped dies in a hydraulic press and hot pressed at a suitable temperature and at a relatively low strain rate to consolidate the metal powder. Then the consolidated metal powder preform is forged and/or machined to form the final shape of a metal article.

The metal powder may be consolidated using hot isostatic pressing by applying heat and supplying pressurised inert gas in a HIPPING vessel. Alternatively the metal powder may be consolidated using hot isostatic pressing by applying heat in an air furnace such that the metal powder is consolidated under atmospheric pressure due to the vacuum in the container. However, residual internal porosity in the consolidated metal powder preform is removed during subsequent hot forming operations.

The metal powder may be a conventionally produced metal powder or preferably may be a metal powder produced by the chemical or electrochemical processing directly from metal compounds as described in WO 01/62994A or WO2004/024963A.

The advantage of the present invention is that it is much simpler than the present method of forming a fan blade or fan outlet guide vane. The present invention dispenses with the need to shape two separate metal workpieces, to diffusion bond the metal workpieces together and then to hot form, or superplastically form, at least one of the metal workpieces to form the hollow fan blade or fan outlet guide vane.

We claim:

1. A method of manufacturing a hollow article by powder metallurgy comprising the steps of (a) forming a container, (b) placing at least one metal insert at a predetermined position within the container and filling the container with metal powder, the at least one metal insert having a predetermined pattern of stop off material on at least one surface of the metal insert, (c) evacuating the container, (d) sealing the container, (e) hot pressing the container to consolidate the metal powder into a consolidated metal powder preform, (f) removing the container from the consolidated metal powder preform, (g) heating the consolidated metal powder preform and supplying a fluid to the predetermined pattern of stop off material to hot form at least a portion of the consolidated metal powder preform to form a hollow metal article.

2. A method as claimed in claim 1 wherein step (a) comprises forming two workpieces and welding the workpieces together to form the container.

3. A method as claimed in claim 2 wherein step (a) comprises cold pressing the workpieces to a predetermined shape to form the container.

4. A method as claimed in claim 1 wherein step (a) comprises forming the container from metal.

5. A method as claimed in claim 1 wherein step (e) comprises hot pressing the container in shaped dies.

6. A method as claimed in claim 1 wherein step (e) comprises hot isostatic pressing.

7. A method as claimed in claim 1 wherein step (f) is selected from the group comprising peeling off the container and dissolving the container in an acid.

8. A method as claimed in claim 1 wherein the metal powder is titanium alloy.

9. A method as claimed in claim 1 wherein the metal insert comprises a titanium alloy.

10. A method as claimed in claim 1 wherein the stop off material comprises yttria.

11. A method as claimed in claim 1 wherein step (g) comprises supplying a gas to the predetermined pattern of stop off material.

12. A method as claimed in 1 wherein the hollow article is a component of a gas turbine engine.

13. A method as claimed in claim 12 wherein the hollow article is selected from the group consisting of a compressor blade, a compressor vane, a fan blade and a fan outlet guide vane.

* * * * *